US005763354A

United States Patent [19]

Nagamoto

[11] Patent Number: 5,763,354

[45] Date of Patent: Jun. 9, 1998

[54] LINER-LESS THERMOSENSITIVE RECORDING MATERIAL HAVING THERMOSENSITIVE ADHESIVE LAYER

[75] Inventor: Masanaka Nagamoto, Susono, Japan

[73] Assignee: Ricoh Co., Ltd., Tokyo, Japan

[21] Appl. No.: 773,513

[22] Filed: Dec. 23, 1996

[30] Foreign Application Priority Data

Dec. 21, 1995 [JP] Japan ..... 7-349034

[51] Int. Cl.[6] ..... B41M 5/40

[52] U.S. Cl. ..... 503/201; 427/152; 503/200; 503/206; 503/207; 503/226

[58] Field of Search ..... 503/200, 201, 503/206, 207, 226; 427/150–152

[56] References Cited

U.S. PATENT DOCUMENTS 4,777,079 10/1988 Nagamoto et al. ..... 428/212
5,053,267 10/1991 Ide et al. ..... 428/195
5,110,389 5/1992 Hiyoshi et al. ..... 156/234
5,248,543 9/1993 Yamaguchi et al. ..... 428/195

*Primary Examiner*—Bruce H. Hess
*Attorney, Agent, or Firm*—Oblon, Spivak, McClelland, Maier & Neustadt, P.C.

[57] ABSTRACT

A liner-less thermosensitive recording material having a substrate, a thermosensitive coloring layer formed on one side of the substrate, a thermosensitive adhesive layer which is formed on the other side of the substrate and becomes adhesive when activated, while being non-adhesive in a normal state, an optional protective layer formed on the thermosensitive coloring layer, and perforation which is formed perpendicular to the longitudinal direction of the liner-less thermosensitive recording material, wherein length of a non-cut part of the perforation is smaller than about 1.5 mm and a ratio of total length of cut parts to total length of the non-cut parts in the perforation is at least 2.

23 Claims, 1 Drawing Sheet

LINER-LESS THERMOSENSITIVE RECORDING MATERIAL HAVING THERMOSENSITIVE ADHESIVE LAYER

BACKGROUND OF THE INVENTION

1. Field of the Invention

The present invention relates to a thermosensitive recording material, and, more particularly, to a liner-less thermosensitive recording material having a thermosensitive adhesive layer.

2. Discussion of the Background

A thermosensitive recording material is known which has a substrate, a thermosensitive coloring layer which is formed on the substrate, and, when necessary, a protective layer formed on the thermosensitive coloring layer. Such a thermosensitive recording material is now widely used as a recording material for price labels which are attached on packages of goods or on the goods themselves. The price label is usually produced as follows:

(1) a pressure-sensitive adhesive layer is formed on the non-layered side of the substrate of the thermosensitive recording material, (2) a liner is superimposed on the pressure-sensitive adhesive layer to prevent adhesion of the thermosensitive coloring layer and the pressure-sensitive adhesive layer when the thermosensitive recording material having the pressure-sensitive adhesive layer is wound, (3) the thermosensitive recording material with the liner is slit to a desired width, and (4) the slit thermosensitive recording material with the liner is dyed to form a series of labels on the liner after printed symbols or characters thereon, when necessary.

The formed series of labels on the liner are recorded as an image on the thermosensitive coloring layer by a recording machine and each of the image recorded labels is attached on packages or goods one by one by hand or by using a labeling machine after separating from the liner.

The thermosensitive recording material with a liner is useful but has the following disadvantages:

(1) the liner has larger dimensions than the thermosensitive recording material and has to be attached to the thermosensitive recording material not only during storage but also during an image recording process, resulting in handling difficulty;

(2) when attaching an image recorded label to goods, the label must be removed from the liner, resulting in low operation efficiency and productivity;

(3) the liner must be disposed after being removed from the image recorded label, resulting in environmental pollution; and (4) manufacturing cost is relatively high because the liner is expensive and many process steps are required for making the thermosensitive recording label with a liner.

In attempting to solve these problems, liner-less thermosensitive recording materials have been proposed. For example, a liner-less thermosensitive recording material having a micro-capsuled adhesive layer or having a releasing layer on a protective layer, which can easily release from an pressure-sensitive adhesive layer which contacts the releasing layer when the liner-less thermosensitive recording material is wound to form a sheet roll, is disclosed in Japanese Laid-open Utility Model Applications Nos. 59-43979 and 59-46265 and Japanese Laid-Open Patent Application No. 60-54842. However, the adhesive strength of the adhesive layers of these labels is inadequate to securely adhere the label to various goods and symbols or characters cannot be printed on an image recording surface of the thermosensitive recording label because of the high releasability of the releasing layer. For these reasons and others, these liner-less thermosensitive recording labels are not practical for use.

Japanese Laid-Open Patent Application No. 63-303387 and Japanese Utility Model Publication No. 5-11573 disclose liner-less thermosensitive recording materials which have a thermosensitive adhesive layer. However, these materials have the following disadvantages:

(1) the thermosensitive coloring layer tends to be colored when heat is applied to activate the thermosensitive adhesive layer and, accordingly, the degree of background whiteness of an recorded image decreases;

(2) the adhesive strength is inadequate to securely adhere the label to various goods; and (3) high temperature heat is required for activating the thermosensitive adhesive layer and, consequently, a risk of fire or burn injury is presented.

For forming a piece of label, a liner-less thermosensitive recording material must be cut by a cutter, such as rotary cutter, after image recording because the liner-less material cannot be dyed. If a liner-less thermosensitive recording material is cut to form a piece of label while the adhesive layer thereof is activated, the adhesive agent of the adhesive layer is stuck to a blade of the cutter, resulting in cutting problems. Even if a liner-less thermosensitive recording material is cut when the adhesive layer is not activated, the adhesive agent is gradually adhered to the cutter in continuous cutting of labels, thereby shortening the life of the cutter or making the cut end of the labels unattractive.

Hence, a need exists for a liner-less thermosensitive recording material having a high degree of background whiteness of a recorded image without coloring and good adhering properties without adhesion of the adhesive agent to a cutting blade.

SUMMARY OF THE INVENTION

Accordingly, it is an object of the present invention to provide a liner-less thermosensitive recording material having a high degree of background whiteness of a recorded image without coloring and good adhering properties without adhesion of the adhesive agent to a cutting blade.

The above object and other objects of the present invention which will become apparent from the following description are achieved by a liner-less thermosensitive recording material.

In more detail, the present invention provides a liner-less thermosensitive recording material having a substrate, a thermosensitive coloring layer formed on one side of the substrate, a thermosensitive adhesive layer which is formed on the other side of the substrate and which becomes adhesive when activated while being non-adhesive in a normal state, an optional protective layer formed on the thermosensitive coloring layer, and perforation which is formed perpendicularly to the longitudinal direction of the liner-less thermosensitive recording material wherein a length of a non-cut part is about 1.5 mm or smaller and a ratio of total length of cut parts to total length of the non-cut parts is at least about 2.

DESCRIPTION OF THE PREFERRED EMBODIMENTS

Figure 1:
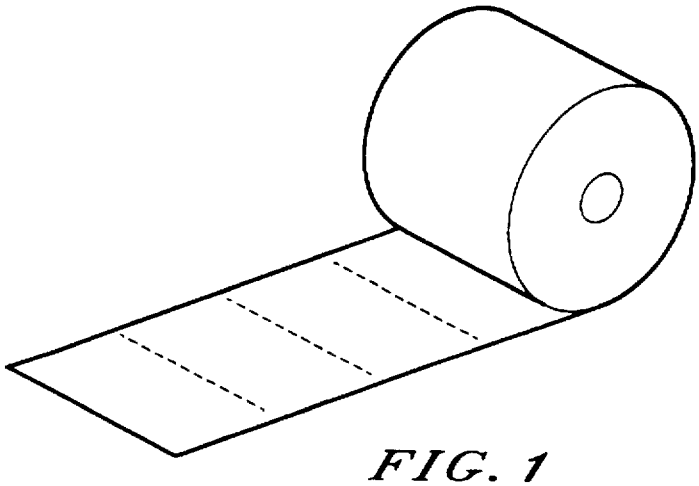
FIG. 1 is a perspective diagram illustrating an embodiment of a liner-less thermosensitive recording material of the present invention.

According to the present invention, there is provided a liner-less thermosensitive recording material with a thermosensitiave adhesive layer (referred to herein as a liner-less label) having a high degree of background whiteness of a recorded image without coloring and good adhering properties without adhesion of the adhesive agent to a cutting blade.

The liner-less label of the present invention has a substrate, a thermosensitive coloring layer formed on one side of the substrate, a thermosensitive adhesive layer which is formed on the other side of the substrate and becomes adhesive when activated while being non-adhesive in a normal state, an optional protective layer formed on the thermosensitive coloring layer, and perforation which is formed perpendicularly to the longitudinal direction of the liner-less label wherein a length of a non-cut part is preferably about 1.5 mm or smaller and a ratio of total length of the cut parts to total length of the non-cut parts is preferably at least about 2. It is more preferable that the ratio of the total length of the cut parts to the total length of the non-cut parts be about 3 to 10.

In an alternative embodiment, the tensile strength of the perforation is about 2.5 kg/cm or smaller.

In another embodiment, the liner-less thermosensitive recording material further includes a repeating pre-print image formed on the thermosensitive coloring layer or the protective layer and the perforation is formed between each pre-print image.

In yet another embodiment, a heat insulating layer which includes a fine particle having a hollow therein whose shell includes a resin is formed between the substrate and the thermosensitive coloring layer and/or between the substrate and the thermosensitive adhesive layer.

In still another embodiment, the fine particle having a hollow therein has an average particle diameter of about 0.4 to 10 μm and a hollow/particle diameter ratio of at least about 30%.

In a further embodiment, the thermosensitive adhesive layer includes an infrared absorbing agent which absorbs an infrared ray having a wave length of about 0.7 to 2.5 μm.

In a still further embodiment, the liner-less thermosensitive recording material has an intermediate layer which is formed between the substrate and the thermosensitive coloring layer and includes an infrared absorbing agent which absorbs an infrared ray having wave length of about 0.7 to 2.5 μm.

In a still further embodiment, the infrared absorbing agent is carbon black or graphite.

In a still further embodiment, the infrared absorbing agent is present in a dissolved state or in a state having particles of 2 μm or smaller in diameter and in an amount of about 0.005 to 0.3 g/m$^2$ in the thermosensitive adhesive layer and/or in the intermediate layer.

In another embodiment, a barrier layer is formed between the substrate and the thermosensitive adhesive layer.

In yet another embodiment, the barrier layer includes a water-soluble resin and is formed in a coating amount of about 0.1 to 5 g/m$^2$ on a dry basis.

For a further description of the present invention, reference will now be made to FIGS. 1, 2A and 2B.

FIG. 1 shows a liner-less label roll, according to the present invention, which is perforated perpendicularly to the longitudinal direction of the liner-less label roll after the liner-less label roll is formed by coating an adhesive layer on the non-layered side of the liner-less label and slit to a desired width.

Figure 2A:
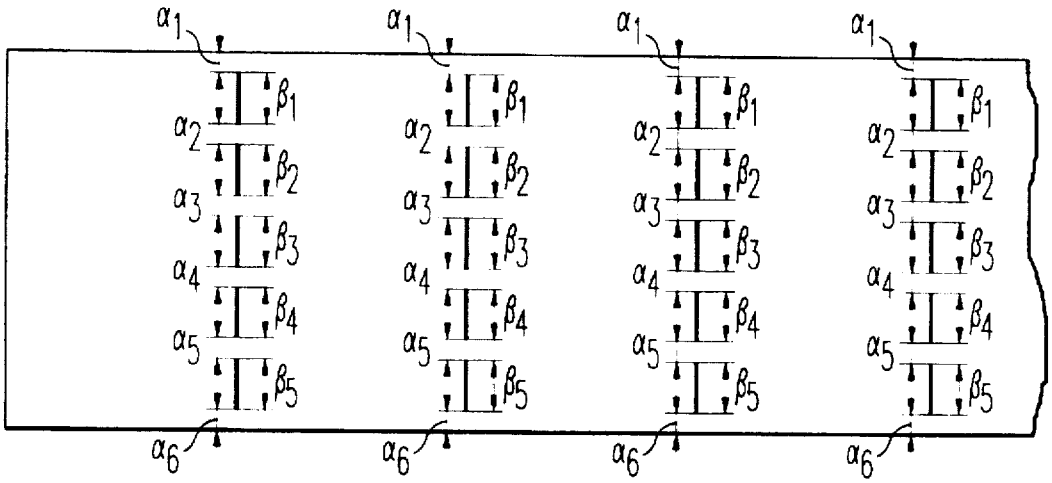
FIGS. 2A and 2B are schematic diagrams illustrating an embodiment of a liner-less thermosensitive recording material of the present invention.
Figure 2B:
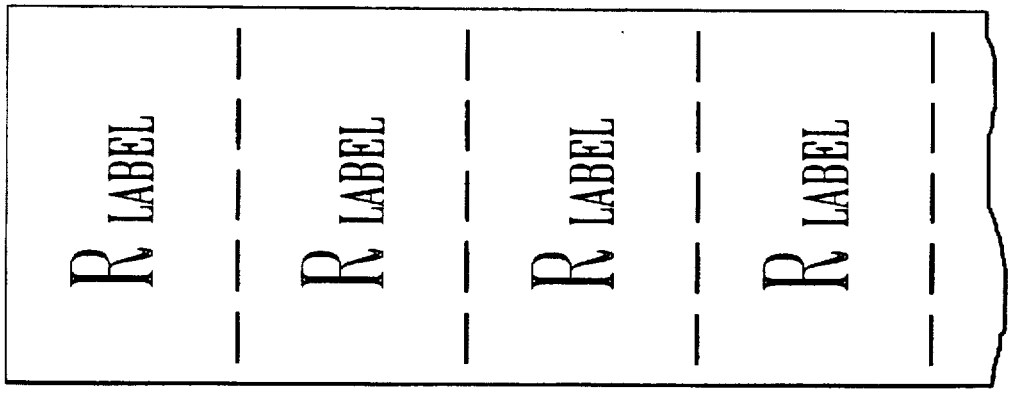

FIG. 2A is an enlarged schematic illustration of a liner-less label roll for showing a perforation of the liner-less label. In FIG. 2A, references α1–α6 represent non-cut parts of the perforation and references β1–β5 represent cut parts of the perforation. As described above, in the liner-less label of the present invention, perforation is formed on the liner-less label so that the perforation is perpendicular to the longitudinal direction of the liner-less label wherein length of a non-cut part (α1, α2, α3, α4, α5 and α6 in FIG. 2A) is preferably 1.5 mm or smaller and a ratio of cut parts (the total length of β1, β2, β3, β4 and β5 in FIG. 2A) to the non-cut parts (the total length of α1, α2, α3, α4, α5 or α6 in FIG. 2A) is preferably at least 2. In an embodiment of the present invention shown in FIG. 2B, perforation is formed between each printed image. When the length of the non-cut part is about 1.5 mm or smaller and the ratio of the total length of the cut parts to the total length of the non-cut parts is at least about 2, the liner-less label roll can be easily cut off at the perforation to be a piece of label. The easiness of label cutting depends on tearing strength of the liner-less label. The tearing strength is increased when a sheet having relatively high tearing strength such as, thick paper, paper made of softwood pulp, synthetic paper or a plastic film is employed for the substrate of the label and an adhesive layer is formed thereon. Therefore, if a sheet being relatively thick or having relatively high tearing strength is employed for the substrate of the liner-less label of the present invention, the ratio of the total length of the cut parts to the total length of the non-cut parts in the perforation must be larger than in the case of using a substrate being relatively thin or having relatively low tearing strength.

When the tensile strength of the perforation of the liner-less label is about 2.5 kg/cm or smaller, a piece of label can be easily cut off at the perforation of the liner-less label by hand, a cutter such as rotary cutter or the like. The liner-less label of the present invention may be cut off at the perforation so easily that the adhesive agent of the thermosensitive adhesive layer hardly adheres to a cutting blade.

As a perforating method for use in the present invention, any conventional perforating method may be used. For example, a perforating method can be used in which a rotator having a blade rotates and presses a feeding liner-less label sheet to perforate the label or a plate having a blade presses a liner-less label sheet to perforate the label.

The thermosensitive adhesive layer of the present invention is not adhesive in a normal state, yet becomes adhesive when activated by heat, light or the like. An infrared absorbing agent is preferably included in the thermosensitive adhesive layer to activate the thermosensitive adhesive layer by absorbing light. This includes an infrared ray for safety purposes. An infrared absorbing agent may be also included in an intermediate layer formed between the thermosensitive adhesive layer and the substrate.

The infrared absorbing agent used in the present invention should effectively absorb infrared radiation of a wave length of about 0.7 to 20 μm, to convert the light into heat.

Specific examples of infrared absorbing agents which may be used, but are not limited to, are as follows:

near-infrared absorbing dyes cyanine type dye, pyrylium type dye, thiopyrylium type dye, triarylmethane type dye, thiol nickel complex type dye, phthalocyanine type dye such as, phthalocyanine cobalt, naphthalocyanine type dye, and anthraquinone type dye.

organic compounds triphenyl phosphate, 2-ethylhexyl diphenylphosphate, furfuryl acetate, bis(1-thio-2-phenolate)nickel-tetrabutylammonium, bis(1-thio-2-naphtolate)nickel-tetrabutylammonium, 1,1'-diethyl-4,4'-quinocarbocyanineiodide, and 1,1'-diethyl-6,6'-quinotricarbocyanineiodide.

inorganic compounds metal oxide, such as aluminum oxide, metal. hydroxide, such as aluminum hydroxide, and magnesium hydroxide, silicate minerals, such as olivine, garnet, pyroxene, amphibole, mica, feldspar, silica minerals, and clay minerals, silicate compounds, such as zinc silicate, magnesium silicate, calcium silicate, and barium silicate, phosphate compounds, such as zinc phosphate, nitride compounds, such as, trisilicon tetranitride, and boron nitride, sulfate compounds, such as barium sulfate, calcium sulfate, and strontium sulfate, carbonate compounds, such as calcium carbonate, barium carbonate, magnesium carbonate, and zinc carbonate, nitrate compounds, such as potassium nitrate.

Infrared absorbing agents are widely classified into two types. The first type is solvent-soluble infrared absorbing agents and the second type is solvent-insoluble infrared absorbing agents (referred to as solvent-dispersible infrared absorbing agents). Generally, the solvent-dispersible infrared absorbing agents are colored black or dark gray, and have wider, larger and more uniform absorption over the entire infrared region of about 0.7 to 2.5 μm in wave length than the solvent-soluble infrared absorbing agents and, further, have high efficiency in converting infrared radiation into heat and exhibit good stability over time. Therefore, the solvent-dispersible infrared absorbing agents are preferably employed for the thermosensitive adhesive layer of the liner-less label of the present invention.

Suitable infrared absorbing agents for use in the thermosensitive adhesive layer of the present invention include known substances which has uniform and large absorption in an infrared region of about 0.7 to 2.5 μm in wave length. Carbon black or graphite are particularly preferred because of their superior infrared-absorbing property.

Carbon black used in accordance with the present invention includes known carbon black such as, channel black or furnace black, for example.

Graphite used in accordance with the present invention includes natural graphite such as, flaky graphite, granular graphite, massive graphite and earthy graphite, and synthetic graphite. Carbon black or graphite is preferably pulverized by a dry type or a wet type pulverizing method so that the average diameter is smaller than about 2.0 μm or treated by a chemical method so as to be colloidal when used in the thermosensitive adhesive layer. Fine particle carbon black or graphite has superior efficiency of converting an infrared ray into heat compared with other infrared absorbing agents.

When infrared absorbing agents are included in a thermosensitive adhesive layer and/or an intermediate layer, the preferable content of the infrared absorbing agent is about 0.005 to 0.3 g/m$^2$ to maintain whiteness of the liner-less label, itself, and the background of the printed image on the liner-less label and to prevent the recording surface of the liner-less label from contamination.

As a coating method for the infrared absorbing agents, any known application method may be used. For example, carbon black is mixed with a thermosensitive adhesive agent, coated on a substrate and dried to form a thermosensitive adhesive layer so that the coating amount of the infrared absorbing agent is about 0.005 to 0.3 g/m$^2$. The preferred coating amount of the thermosensitive adhesive layer depends on an amount of the energy of infrared rays for activating the employed infrared absorbing agent and is typically about 10 to 30 g/m$^2$.

In addition, a barrier layer may be formed between the substrate and the thermosensitive adhesive layer to prevent the thermosensitive adhesive layer from soaking into the substrate when the thermosensitive adhesive layer is coated.

The preferred resin for use in the barrier layer of the present invention includes water-soluble polymer resins.

Specific examples of the water-soluble polymer resins which may be used are, but not limited to, as follows:

polyvinyl alcohol, carboxy-modified polyvinyl alcohol, amino-modified polyvinyl alcohol, epoxy-modified polyvinyl alcohol, cellulose derivatives, starch and its derivatives, polyacrylic acid and its derivatives, styrene-acrylic acid copolymer and its derivatives, poly(meth)acrylamide and its derivatives, styrene-acrylic acid-acrylamide copolymer, polyethylene imine, and isobutylene-maleic anhydride copolymer and its derivatives.

In addition, the barrier layer may include a filler to improve a drying property when the barrier layer is coated.

Specific examples of the fillers are as follows, but are not limited to:

inorganic fillers calcium carbonate, silica, zinc oxide, titanium dioxide, aluminum hydroxide, zinc hydroxide, barium sulfate, clay, talc, surface treated calcium carbonate, and surface treated silica, organic fillers urea-formaldehyde resin, styrene-methacrylic acid copolymer, and polystyrene.

Further, a heat insulating layer may be formed between the substrate and the thermosensitive coloring layer to improve the thermosensitivity by effectively blocking the diffusion of heat, applied to the thermosensitive coloring layer for recording an image, through the substrate and to prevent unexpected color formation of the thermosensitive coloring layer upon application of heat generated by absorption of an infrared ray applied for activating the thermosensitive adhesive layer.

The heat insulating layer of the present invention, includes a fine hollow particle whose shell includes a resin and which has an average particle diameter of about 2.0 to 20 μm and a hollow/particle ratio of at least about 30%.

The fine hollow particle for use in the heat insulating layer of the present invention has a hollow which has been already formed therein. The average diameter of the hollow particle is preferably about 2.0 to 20 μm, and more preferably about 3.0 to 10 μm to maintain good thermosensitivity of the liner-less label. The hollow/particle ratio is preferably at least about 30%, and more preferably at least about 50% to maintain good thermosensitivity of the liner-less label. The hollow/particle ratio is defined by the following equation:

hollow/particle ratio=(diameter of a hollow)/(outside diameter of the particle)×100 (%).

The resin used for the shell of the hollow particle includes known resins, and is preferably vinylidene chloride-acrylonitrile copolymer.

Suitable-manufacturing methods for the heat insulating layer for use in the present invention includes known conventional manufacturing methods. For example, a coating liquid is prepared in which the above-mentioned hollow particles are dispersed in an aqueous solution of a binder resin, an aqueous resin emulsion or the like. Then the coating liquid is coated on a substrate and dried to form a heat insulating layer. The coating weight of the hollow particles is preferably at least about 1 g/m$^2$, and more preferably about 2 to 15 g/m$^2$. The weight ratio of the binder resin to the total weight of the heat insulating layer is preferably about 2 to 50% to securely adhere the heat insulating layer to the substrate.

The binder resin which may be used in the heat insulating layer of the present invention includes known water-soluble resins and aqueous resin emulsions.

Specific examples of the binder resins are as follows:

water-soluble resins polyvinyl alcohol, starch and its derivatives, cellulose derivatives such as, methoxycellulose, hydroxyethylcellulose, carboxymethylcellulose, methylcellulose, and ethylcellulose, sodium salts of polyacrylic acid, polyvinylpyrrolidone, acrylamide-acrylate copolymer, acrylamide-acrylate-methacrylic acid terpolymer, alkali metal salts of styrene-maleic anhydride copolymer, alkali metal salts of isobutylene-maleic anhydride copolymer, polyacrylamide, sodium alginate, gelatin, and casein, resin emulsions styrene-butadiene copolymer, styrene-butadiene-acrylate terpolymer, vinyl acetate resin, vinyl acetate-acrylic acid copolymer, styrene-acrylate copolymer, polyacrylate, and polyurethane.

The heat insulating layer may further include auxiliary agents such as, thermofusible materials, surface active agents, fillers and the like.

The specific examples of the thermofusible materials are the materials employed for thermosensitive coloring layer which are described later.

The thermosensitive adhesive agents for use in the thermosensitive adhesive layer of the present invention basically include materials selected from each of the following groups:

(a) polymer resins such as, polyvinyl acetate, polybutylmethacrylate, vinyl acetate-vinylidene chloride copolymer, synthetic rubber, vinyl acetate-2-ethylhexylacrylate copolymer, vinylcopolyate-ethylene copolymer, vinylpyrrolidone-styrene copolymer, styrene-butadiene copolymer, and vinylpyrrolidone-ethylacrylate copolymer, (b) plasticizer which is solid in the normal temperature such as, diphenyl phthalate, dihexyl phthalate, dicyclohexyl phthalate, dihydroabietyl phthalate, dimethyl isophthalate, sucrose benzoate, ethylene glycol dibenzoate, trimethylol ethane tribenzoate, glycerin tribenzoate, pentaerythritol tetrabenzoate, sucrose octabenzoate, tricyclohexyl citrate, N-cyclohexyl-p-toluene sulfonamide, (c) tackifier, for example, rosin derivatives such as, rosin, polymerized rosin, hydrogenated rosin and its esters with glycerin or pentaerythritol, and dimer of resin acids, terpenic resins, petroleum resins, phenolic resins, and xylene resin.

Suitable light sources for activating the thermosensitive adhesive agent in the present invention include the known lamps which irradiates light including an infrared ray having wave length of about 0.7 to 20 μm. Specific examples of the lamp are a xenon flush lamp, quartz flush lamp, halogen lamp, or mercury lamp, for example. The lamp is preferably selected depending on the light absorbing property of the infrared absorbing agent included in the thermosensitive adhesive layer or the intermediate layer.

As the leuco dye for use in the thermosensitive coloring layer of the present invention, which may be employed individually or in combination, any known dye for use in the conventional -thermosensitive recording materials can be employed. For example, triphenylmethane-type leuco compounds, fluoran-type leuco compounds, phenothiazine-type leuco compounds, auramine-type leuco compounds, spiropyran-type leuco compounds, indolinophthalide-type leuco compounds are preferably employed.

Specific examples of those leuco dyes are as follows:

3,3-bis(p-dimethylaminophenyl)phthalide, 3,3-bis(p-dimethylaminophenyl)-6-dimethylaminophthalide (or Crystal Violet Lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-5-methyl-7-anilinofluoran,
3-pyrrolidino-6-methyl-7-anilinofluoran,
2-{N-(3'-trifluoromethylphenyl)amino}-6-diethylaminofluoran,
2-{3,6-bis(diethylamino)-9-(o-chloroanilino) xanthyl}benzoic acid lactam,
3-diethylamino-6-methyl-7-(m-trichloromethylanilino) fluoran,
3-diethylamino-7-(o-chloroanilino)fluoran,
3-di-n-butylamino-7-(o-chloroanilino)fluoran,
3-(N-methyl-N-n-amylamino)-6-methyl-7-anilinofluoran,
3-(N-methyl-N-cyclohexylamino)-6-methyl-7-anilinofluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2-methoxy-5-chlorophenyl) phthalide,
3-(2'-hydroxy-4'-dimethylaminophenyl)-3-(2'-methoxy-5'-nitrophenyl) phthalide,
3'-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methyphenyl)phthalide,
3-(N-ethyl-N-tetrahydrofurfurylamino)-6-methyl-7-anilinofluoran,
3-(N-ethyl-N-2-ethoxypropylamino)-6-methyl-7-anilinofluoran,
3-N-methyl-N-isobutyl-6-methyl-7-anilinofluoran,
3-morphorino-7-(N-propyl-trifluoromethylanilino) fluoran,
3-pyrrolidino-7-m-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino) fluoran,
3-diethylamino-5-methyl-7-(α-phenylethylamino) fluoran,
3-diethylamino-7-piperidinofluoran,
2-chloro-3-(N-methyltoluidino)-7-(p-n-butylanilino) fluoran,
3-(N-methyl-N-isopropylamino)-6-methyl-7-anilinofluoran,
3-di-n-butylamino-6-methyl-7-anilinofluoran,
3,6-bis(dimethylamino)fluorenespiro(9,3')-6'-dimethyl-aminophthalide,
3-(N-benzyl-N-cyclohexylamino)-5,6-benzo-7-α-naphthyl-amino-4'-bromofluoran,
3-diethylamino-6-chloro-7-anilinofluoran,
3-diethylamino-6-methyl-7-mesidino-4',5'-benzofluoran,
3-N-methyl-N-isopropyl-6-methyl-7-anilinofluoran,
3-N-ethyl-N-isoamyl-6-methyl-7-anilinofluoran, and
3-diethylamino-6-methyl-7-(2',4'-dimethylanilino) fluoran.

As the coloring developer for use in the thermosensitive coloring layer of the present invention, any conventional electron acceptor or oxidizing agent which works upon the above-mentioned leuco dyes to induce color formation can be employed.

Specific examples of such color developers are as follows:

4,4'-isopropylidenediphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol), zinc p-nitrobenzoate,
1,3,5-tris(4-tert-butyl-3-hydroxy-2,6-dimetylbenzyl) isocyanuric acid,
2,2-(3,4'-dihydroxydiphenyl)propane,
bis(4-hydroxy-3-methylphenyl)sulfide,
4-{β-(p-methoxyphenoxy)ethoxy}salicylate,
1,7, -bis(4-hydroxyphenylthio)-3,5-dioxaheptane,
1,5-bis(4-hydroxyphenylthio)-5-oxapentane,
1,3-bis(4-hydroxyphenylthio) propane,
1,3-bis(4-hydroxyphenylthio)-2-hydroxypropane,
monocalcium salts of monobenzylphthalate,
2,2-methylenebis(4-methyl-6-tert-butylphenol),
2,2'-methylenebis(4-methyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl) butane,
4,4'-thiobis(6-tert-butyl-2-methylphenol),
4,4'-diphenolsulfone,
4-isoproxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
N, N'-diphenylthiourea,
N,N'-di(m-chlorophenyl)thiourea,
salicylanilide,
5-chloro-salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
3,3'-diallyl-4,4'-diphenolsulfone,
3,4-dihydroxy-4'-methyldiphenylsulfone,
2-hydroxy-l-naphthoate,
2-hydroxy-3-naphthoate,
1-hydroxy-2-naphthoate,
zinc salts of hydroxynaphthoate,
aluminum salts of hydroxynaphthoate,
calcium salts of hydroxynaphthoate,
α,α-bis(4-hydroxyphenyl)-α-methyltoluene, antipyrine complex of zinc thiocyanate, tetrabromobisphenol A, tetrabromobisphenol S, 4,4'-thiobis(2-methylphenol), 4,4'-thiobis(2-chlorophenol), o-(benzenesulfonylaminocarbonyl)benzoic acid methyl ester, o-(benzenesulfonylaminocarbonyl)benzoic acid ethyl ester, 4,4'-bis(p-toluenesulfonylaminocarbonylamino) diphenylmethane, 4,4'-bis(p-toluenesulfonylaminocarbonylamino) diphenylsulfide, 4,4'-bis(p-toluenesulfonylaminocarbonylamino) diphenylether, 3,4'-bis(p-toluenesulfonylaminocarbonylamino) diphenylether, 1,2-bis{4-(p-toluenesulfonylaminocarbonylamino) phenyl}-ethane, and 2,8-dimethyl-3,7-(p-toluenesulfonylaminocarbonyl-amino)dibenzothiophenyl-5,5-dioxide.

A variety of conventional binders can be employed for binding the above-mentioned leuco dyes and coloring developers to a substrate of the liner-less label of the present invention.

Specific examples of the binders are as follows:

water soluble polymers polyvinyl alcohol, carboxy-modified polyvinyl alcohol, starch and starch derivatives, cellulose derivatives, such as methoxycellulose, hydroxyethylcellulose, carboxymethylcellulose, methylcellulose, and ethylcellulose, sodium salts of polyacrylic acid, polyvinylpyrrolidone, acrylamide-acrylate copolymer, acrylamide-acrylate-methacrylic acid copolymer, alkali salts of styrene-maleic anhydride copolymer, alkali salts of isobutylene-maleic anhydride copolymer, polyacrylamide, sodium alginate, gelatin, and casein, emulsions styrene-butadiene copolymer, styrene-butadiene-acrylate copolymer, polyvinyl acetate, vinyl acetate-acrylic acid copolymer, styrene-acrylate copolymer, polyurethane, polyacrylate, polymethacrylate, vinyl chloride-vinyl acetate copolymer, and ethylene-vinyl acetate copolymer.

Further, when necessary, the auxiliary components which are used in the conventional thermosensitive recording materials such as a filler, a thermofusible material, and a surface active agent can be added to the thermosensitive coloring layer.

Specific examples of the filler are finely-pulverized particles of inorganic fillers such as calcium carbonate, silica, zinc oxide, titanium dioxide, aluminum hydroxide, zinc hydroxide, barium sulfate, clay, talc, surface-treated calcium carbonate, surface-treated silica, and finely-divided particles of organic fillers such as urea-formaldehyde resin, styrene-methacrylic acid copolymer, and polystyrene resin.

Specific examples of the thermofusible materials are thermofusible compounds with a melting point ranging from about 50° to 200° C., such as higher fatty acid and esters, amide and metal salts thereof, a variety of waxes, condensates of aromatic carboxylic acid and amines, phenyl benzoate, higher linear glycol, 3,4-epoxy-dialkyl hexahydrophthalate, higher ketone and p-benzylbiphenyl.

The formation of the thermosensitive coloring layer of the present invention can be achieved by the steps of preparing a coating liquid, coating the liquid on a substrate, and drying the coated liquid. The coating liquid can be prepared by mixing and dispersing in water a leuco dye, a coloring developer, and a binder with auxiliary components when necessary.

Further, if desired, the liner-less label of the present invention may include a protective layer which is provided on the thermosensitive coloring layer in order to improve the resistance to plasticizers and oils. A variety of organic polymers which are used in the conventional thermosensitive recording materials can be employed for the protective layer of the present invention.

Specific examples of organic polymers are as follows: water soluble-resins such as polyvinyl alcohol, carboxy-modified polyvinyl alcohol, amino-modified polyvinyl alcohol, epoxy-modified polyvinyl alcohol, starch and starch derivatives, cellulose derivatives such as methoxycellulose, hydroxyethylcellulose, carboxymethylcellulose, methylcellulose, ethylcellulose, polyacrylic acid and derivatives thereof, styrene-acrylic acid copolymer and derivatives thereof, poly(meth)acrylamide and derivatives thereof, styrene-acrylic acid-acrylamide copolymer, polyethylene imine, aqueous polyester, aqueous polyurethane, isobutylene-maleic anhydride copolymer and derivatives thereof, polymer emulsions such as polyester, polyurethane, acrylic acid (co) polymer, styrene-acrylate copolymer, epoxy resin, polyvinyl acetate, polyvinylidene chloride, polyvinyl chloride and derivatives thereof. Among these resins, the water-soluble resins are preferable for use in the protective layer to improve the resistance of the colored image to plasticizer and oils.

Furthermore, the protective layer preferably includes waterproof agents which react with a water-soluble resin to produce a waterproof protective layer.

Examples of waterproof agents which may be used are as follows:

formaldehyde, glyoxal, chrome alum, melamine, melamine-formaldehyde resin, polyamide resin, and polyamide-epichlorohydrin resin.

The protective layer may further include auxiliary agents to prevent sticking to a thermal printhead which is a most popular printing device of thermal printers, or coloring by pressure application. The auxiliary agents are, for example, a filler, a thermofusible material, a lubricant, a surface active agent, and an agent to prevent coloring by pressure application.

The afore-mentioned examples of the fillers or the thermofusible materials in the thermosensitive coloring layer can be also used for the protective layer.

The protective layer may be formed by one or more than two layers in the present invention.

The formation of the protective layer can be made by preparing a coating liquid, coating the liquid on the thermosensitive coloring layer of the present invention, and drying the coated liquid. The coating liquid can be prepared, for example, by mixing and dispersing in water a water-soluble resin with a water-proof agent, a filler, a thermofusible material, a lubricant, a surface active agent, and an agent to prevent coloring by pressure application, when necessary.

The liner-less label may further include a repeated pre-print image on the thermosensitive coloring layer or the protective layer.

The formation of the repeated pre-print image can be formed by conventional printing methods.

Having generally described the present invention, reference will now be made to certain examples which are provided herein for purpose of illustration only and are not intended to be limiting unless clearly indicated as such. In the descriptions in the following examples, numbers are weight ratios unless otherwise specified.

EXAMPLES

Example 1

(Formation of thermosensitive coloring layer)

A mixture of the following compounds was individually pulverized and dispersed in a sand grinder so that the average particle diameter of the solid components in each liquid was below 2 μm, thus a Liquid A and a Liquid B were prepared.

| | |
|---|---|
| (Liquid A) | |
| 3-dibenzylamino-6-methyl-7-anilinofluoran | 20 |
| 10% aqueous solution of polyvinyl alcohol | 20 |
| water | 60 |
| (Liquid B) | |
| 4,4'-dihydroxybenzophenone | 10 |
| 10% aqueous solution of polyvinyl alcohol | 25 |
| calcium carbonate | 15 |
| water | 50 |

The Liquid A and Liquid A were mixed with stirring at a weight ratio of 1:8 to prepare a thermosensitive coloring layer liquid (Liquid C). Then the liquid C was coated on a sheet of paper having a basis weight of 80 g/m$^2$, serving as a substrate, in a coating amount of 5 g/m$^2$ on a dry basis, and dried, thereby a thermosensitive coloring layer was formed on the substrate. The surface of the prepared thermosensitive coloring layer was subjected to calendering so that the Bekk smoothness of the surface of the thermosensitive coloring layer was 600 to 700 sec. Thus, thermosensitive recording material was obtained.

(Formation of thermosensitive adhesive layer)

Then a thermosensitive adhesive agent (DLA-1, solid content of 50%, manufactured by Dainippon Ink and Chemicals, Inc. ) was coated on a non-layered surface of the above-prepared thermosensitive recording material in a coating amount of 25 g/m$^2$ on a dry basis and dried to form a thermosensitive coloring layer. Thus a liner-less thermosensitive recording material was obtained.

(Formation of perforation)

The above-prepared liner-less thermosensitive recording material was slit so that each width of the liner-less thermosensitive recording material was 80 mm and then perforated by a blade so that perforation was perpendicular to the longitudinal direction of the liner-less thermosensitive recording material. The length of the non-cut part of the perforation is 0.5 mm and a ratio of the total length of the cut parts to the total length of the non-cut parts in the perforation was 5. Thus a liner-less thermosensitive recording label was obtained.

Example 2

The thermosensitive coloring layer of the liner-less thermosensitive recording material obtained in Example 1 was printed-an image using UV light vulcanizing ink (OP varnish, manufactured by Dainippon Ink and Chemicals, Inc.) in a pitch of 40 mm. Then the printed liner-less thermosensitive recording material was slit so that the width of the printed liner-less thermosensitive recording material was 80 mm, and perforated in a pitch of 40 mm by the same methods as described in Example 1 to obtain a liner-less thermosensitive recording label.

Example 3

(Formation of heat insulating layer)

A mixture of the following compounds was dispersed to prepare a heat insulating layer liquid (Liquid D).

| | |
|---|---|
| (Liquid D) | |
| fine hollow particle dispersing liquid (copolymer including styrene-acrylic resin, solid content of 32%, average particle diameter of 5 m and hollow/particle ratio of 55 %) | 30 |
| styrene-butadiene latex (solid content of 47.5%) | 10 |
| water | 60 |

The prepared Liquid D was coated on a sheet of paper in a coating amount of 5 g/m$^2$ on a dry basis and dried to form a heat insulating layer.

Then the Liquid C was coated on the heat insulating layer in a coating amount of 5 g/m$^2$ on a dry basis and dried to form a thermosensitive coloring layer. The thermosensitive coloring layer was subjected to calendering so that the Bekk smoothness of the surface of the thermosensitive coloring layer was 600 to 700 sec.

The procedures for the formation of the thermosensitive adhesive layer and for the formation of the perforation in Example 1 were repeated, thereby a liner-less label was obtained.

Example 4

The procedure for the preparation of the liner-less label in Example 3 was repeated except that the fine hollow particle was replaced by a dispersion including vinylidene chloride-acrylonitrile copolymer (solid content of 32%, average particle diameter of 5 m and hollow/particle ratio of 92%)

Example 5

The procedure for the preparation of the liner-less label in Example 1 was repeated except that the heat insulating layer was formed between the substrate and the thermosensitive adhesive layer by the same method as described in Example 3.

Example 6

A mixture of the following compounds was pulverized and dispersed in a sand grinder so that the average particle diameter of the solid components in the liquid was 5 μm. Thus, a Liquid E was prepared.

| | |
|---|---|
| (Liquid E) | |
| phthalocyanine cobalt | 5 |
| 10% aqueous solution of polyvinyl alcohol | 5 |

-continued

| | |
|---|---|
| water | 90 |

The following compounds were dispersed to prepare a Liquid F for an intermediate layer including infrared absorbing agents.

| (Liquid F) | |
|---|---|
| 10% aqueous solution of polyvinyl alcohol | 4 |
| aluminum hydroxide | 44 |
| 10% aqueous solution of polyamide-epichlorohydrin | 16 |
| Liquid E | 8 |
| water | 28 |

Then the procedure for the preparation of the liner-less label in Example 1 was repeated except that an intermediate layer was formed between the substrate and the thermosensitive adhesive layer in a coating amount of 2.5 g/m$^2$ on a dry basis.

Example 7

The procedure for the preparation of the liner-less label in Example 6 was repeated except that the Liquid E was pulverized in a sand grinder so that the average particle diameter of the solid components in the liquid was below 2 μm.

Example 8

The procedure for the preparation of the liner-less label in Example 6 was repeated except that the Liquid E was replaced by a 5% aqueous carbon dispersion (Pollux Black PP-B, manufactured by Sumika Color Co., Ltd.).

Example 9

The procedure for the preparation of the liner-less label in Example 1 was repeated except that a 5% aqueous carbon dispersion (Pollux Black PP-B, manufactured by Sumika Color Co., Ltd.) was mixed in the thermosensitive adhesive agent, DLA-1, so that a weight ratio of Pollux Black PP-B to DLA-1 was 0.4% on a dry basis.

Example 10

A mixture of the following compounds was dispersed to prepare a Liquid G for a barrier layer.

| (Liquid G) | |
|---|---|
| emulsion of styrene-butadiene copolymer (solid content of 50%) | 10 |
| aluminum hydroxide | 2 |
| water | 88 |

Then the procedure for the preparation of the liner-less label in Example 1 was repeated except that a barrier layer was formed between the substrate and the thermosensitive adhesive layer in a coating amount of 2 g/m$^2$ on a dry basis.

Example 11

The procedure for the preparation of the liner-less label in Example 10 was repeated except that the Liquid G was replaced by a-Liquid H.

Example 12

The procedure for the preparation of the liner-less label in Example 1 was repeated except that the substrate was replaced by a sheet of coated paper having a basis weight of 120 g/m$^2$ and the ratio of the total length of the cut parts to the total length of the non-cut parts in the perforation was 9.

Comparative Example 1

The procedure for the preparation of the liner-less label in Example 1 was repeated except that the ratio of the total length of the cut parts to the total length of the non-cut parts in the perforation was 1.

Comparative Example 2

The procedure for the preparation of the liner-less label in Example 1 was repeated except that the length of the non-cut part was 2 mm and the ratio of the total length of the cut parts to the total length of the non-cut parts in the perforation was 0.5.

Comparative Example 3

The procedure for the preparation of the liner-less label in Example 1 was repeated except that there was no perforation in the liner-less label.

In accordance with the following methods, each of the liner-less label according to the present invention in Examples 1 to 12 and comparative liner-less label in Comparative Examples 1 to 3 was evaluated with respect to the cutting property, the dynamic recording image density, the adhesive property of the thermosensitive adhesive layer and the ground density of the thermosensitive coloring layer when activated by light, and the adhesive property of the thermosensitive adhesive layer when activated by heat.

The results are given in Tables 1 and 2.

1. Evaluation methods of cutting property

The cutting property was evaluated by the following three method.

(1) After the liner-less label was recorded an image on the thermosensitive coloring layer using a label printer (KM-705DD, manufactured by Anritsu Corp.), a piece of label was detached by hand from the image recorded liner-less label sheet. The cutting property was observed and classified into the following ranks.

○: The piece of label was easily cut from the image recorded liner-less label and the linearity of the cut line was good.

Δ: The piece of label was not easily cut from the image recorded liner-less label and the linearity of the cut line was moderate.

X: The piece of label was not easily cut from the image recorded liner-less label and the linearity of the cut line was bad.

(2) After the liner-less label was recorded an image on the thermosensitive coloring layer using a label printer (KM-705DD, manufactured by Anritsu Corp.), the thermosensitive adhesive layer of the image recorded liner-less label was activated by a halogen lamp OF 1350 w(TRANSPARENCY MAKER, MANUFACTURED BY 3M) and then a piece of label was detached by hand from the image recorded liner-less label. The cutting property was evaluated by the above-mentioned method.

(3) After the liner-less label was recorded an image on the thermosensitive coloring layer using a label printer (KM-705DD, manufactured by Anritsu Co., Ltd.), 2000 lines of the perforation were successively made with a rotary cutter provided with the label printer. The contamination of the cutter was evaluated by the following classification.

○: There was observed no contamination on the cutting blade.

Δ: There was observed a small amount of adhesive on the cutting blade.

X: There was observed a large amount of adhesive on the cutting blade.

2. Dynamic recording image density

The liner-less label was printed an image by a thermal recording simulator having a thin layer type thermal printhead manufactured by Matsushita Electronic Components Co., Ltd. under the following recording conditions.

| | |
|---|---|
| electric power applied to the printhead | 0.6 W/dot |
| recording time per 1 line | 10 msec/line |
| dot density of main scanning | 8 dots/mm |
| dot density of vertical scanning | 7.7 dots/mm |
| pulse width | 0.4 and 0.5 msec |

The image density was measured with Macbeth reflection densitometer RD-914 manufactured by Macbeth Co.

3. Adhesive property when activated by light

The thermosensitive adhesive layer was superimposed a sheet of polyester film thereon, and irradiated light with a halogen lamp (TRANSPARENCY MAKER, 1350 W, manufactured by 3M Co.) while the liner-less label superimposed by a sheet of polyester film was feeding in a speed of 2, 4, 6, 8, 10 or 12 inches/sec. The adhesive property of the thermosensitive adhesive layer was evaluated by the following classification.

TABLE 1

| | Cutting property | | | Tensile strength of perforated line | Dynamic printing image density | | Adhesive property when activated by |
|---|---|---|---|---|---|---|---|
| | (1) | (2) | (3) | (Kg/cm) | 0.4 ms | 0.5 ms | heat |
| Example 1 | ○ | ○ | ○ | 0.4 | 0.61 | 1.01 | ○ |
| Example 2 | ○ | ○ | ○ | 0.4 | 0.60 | 1.02 | ○ |
| Example 3 | ○ | ○ | ○ | 0.6 | 0.66 | 1.08 | ○ |
| Example 4 | ○ | ○ | ○ | 0.6 | 0.72 | 1.14 | ○ |
| Example 5 | ○ | ○ | ○ | 0.6 | 0.60 | 1.00 | ○ |
| Example 6 | ○ | ○ | ○ | 0.4 | 0.62 | 1.01 | ○ |
| Example 7 | ○ | ○ | ○ | 0.4 | 0.61 | 1.02 | ○ |
| Example 8 | ○ | ○ | ○ | 0.4 | 0.61 | 1.01 | ○ |
| Example 9 | ○ | ○ | ○ | 0.4 | 0.60 | 1.00 | ○ |
| Example 10 | ○ | ○ | ○ | 0.5 | 0.61 | 1.01 | ○ |
| Example 11 | ○ | ○ | ○ | 0.5 | 0.60 | 1.00 | ○ |
| Example 12 | ○ | ○ | ○ | 1.5 | 0.60 | 1.02 | ○ |
| Comparative Example 1 | Δ | Δ | ○ | 2.8 | 0.61 | 1.02 | ○ |
| Comparative Example 2 | Δ | Δ | ○ | 3.2 | 0.62 | 1.06 | ○ |
| Comparative Example 3 | X | X | X | 6.0 | 0.62 | 1.00 | ○ |

TABLE 2

| | Adhesive property when activated by light | | | | | | Ground density when activated by light | | | | | |
|---|---|---|---|---|---|---|---|---|---|---|---|---|
| | 2"/s | 4"/s | 6"/s | 8"/s | 10"/s | 12"/s | 2"/s | 4"/s | 6"/s | 8"/s | 10"/s | 12"/s |
| Example 1 | ○ | X | X | X | X | X | 0.08 | 0.08 | 0.08 | 0.08 | 0.08 | 0.08 |
| Example 2 | ○ | X | X | X | X | X | 0.08 | 0.08 | 0.08 | 0.08 | 0.08 | 0.08 |
| Example 3 | ○ | Δ | X | X | X | X | 0.08 | 0.08 | 0.08 | 0.08 | 0.08 | 0.08 |
| Example 4 | ○ | Δ | X | X | X | X | 0.08 | 0.08 | 0.08 | 0.08 | 0.08 | 0.08 |
| Example 5 | ○ | ○ | Δ | X | X | X | 0.08 | 0.08 | 0.08 | 0.08 | 0.08 | 0.08 |
| Example 6 | ○ | ○ | ○ | Δ | X | X | 0.14 | 0.08 | 0.08 | 0.08 | 0.08 | 0.08 |
| Example 7 | ○ | ○ | ○ | ○ | Δ | X | 0.21 | 0.13 | 0.08 | 0.08 | 0.08 | 0.08 |
| Example 8 | ○ | ○ | ○ | ○ | ○ | Δ | 0.43 | 0.24 | 0.14 | 0.09 | 0.09 | 0.09 |
| Example 9 | ○ | ○ | ○ | ○ | ○ | ○ | 0.58 | 0.42 | 0.28 | 0.15 | 0.10 | 0.10 |
| Example 10 | ○ | Δ | X | X | X | X | 0.08 | 0.08 | 0.08 | 0.08 | 0.08 | 0.08 |
| Example 11 | ○ | ○ | X | X | X | X | 0.08 | 0.08 | 0.08 | 0.08 | 0.08 | 0.08 |
| Example 12 | ○ | X | X | X | X | X | 0.08 | 0.08 | 0.08 | 0.08 | 0.08 | 0.08 |
| Comparative Example 1 | ○ | X | X | X | X | X | 0.08 | 0.08 | 0.08 | 0.08 | 0.08 | 0.08 |
| Comparative Example 2 | ○ | X | X | X | X | X | 0.08 | 0.08 | 0.08 | 0.08 | 0.08 | 0.08 |
| Comparative Example 3 | ○ | X | X | X | X | X | 0.08 | 0.08 | 0.08 | 0.08 | 0.08 | 0.08 |

○: The adhesive layer and polyester film were adhered completely.

Δ: The adhesive layer and polyester film were adhered loosely.

X: The adhesive layer and polyester film were not adhered.

4. Background density of thermosensitive coloring layer

The background density of each thermosensitive coloring layer of the above-mentioned samples irradiated light was measured by Macbeth reflection densitometer RD-914.

5. Adhesive property when activated by heat

The liner-less label superimposed a sheet of polyester film on the adhesive layer was hung dangling in mid-air for 1 min. in an oven heated to 100° C. The adhesive property of the thermosensitive adhesive layer was evaluated by the above-mentioned classification.

As may be observed from the Tables, the liner-less labels of the present invention have good cutting property and good adhesive property when the thermosensitive adhesive layers are activated light or heat. An image recorded label which has both of good adhesive property and relatively low ground density of the recorded image (namely, a relatively high degree of background whiteness) can be obtained by properly irradiating light to the thermosensitive adhesive layer. Therefore, a good liner-less label can be obtained which does not generate environmental pollution and in which an image having a good recording quality is recorded without a dangerous operation such as, heating the thermosensitive adhesive layer by a heater.

Having now fully described the present invention, it will be apparent to one of ordinary skill in the art that many changes and modifications can be made thereto without departing from the spirit and scope of the present invention.

What is claimed as new and desired to be secured by Letters Patent of the United States is:

1. A liner-less thermosensitive recording material comprising a substrate, a thermosensitive coloring layer formed on one side of said substrate, a thermosensitive adhesive layer which is formed on the other side of said substrate and which becomes adhesive when activated, while being non-adhesive in a normal state, an optional protective layer formed on said thermosensitive coloring layer, and perforation which is formed perpendicularly to the longitudinal direction of said liner-less thermosensitive recording material, wherein length of a non-cut part of said perforation is smaller than about 1.5 mm and a ratio of total length of cut parts to total length of the non-cut parts in said perforation is at least about 2.

2. The liner-less thermosensitive recording material of claim 1, said perforation having a tensile strength of smaller than about 2.5 kg/cm.

3. The liner-less thermosensitive recording material of claim 2, wherein said liner-less thermosensitive recording material further comprises a repeating pre-print image formed on at least one of said thermosensitive coloring layer and said protective layer and said perforation is formed between each pre-print image.

4. The liner-less thermosensitive recording material of claim 2, wherein said liner-less thermosensitive recording material further comprises a heat insulating layer which is formed between said substrate and said thermosensitive coloring layer and comprises a fine hollow particle whose shell comprises a resin.

5. The liner-less thermosensitive recording material of claim 2, wherein said liner-less thermosensitive recording material further comprises a heat insulating layer which is formed between said substrate and said thermosensitive adhesive layer and comprises a fine hollow particle whose shell comprises a resin.

6. The liner-less thermosensitive recording material of claim 2, wherein said thermosensitive adhesive layer comprises an infrared absorbing agent which absorbs an infrared ray having wave length of about 0.7 to 2.5 μm.

7. The liner-less thermosensitive recording material of claim 2, wherein said liner-less thermosensitive recording material further comprises an intermediate layer which is formed between said substrate and said thermosensitive coloring layer and comprises an infrared absorbing agent which absorbs an infrared ray having wave length of about 0.7 to 2.5 μm.

8. The liner-less thermosensitive recording material of claim 2, wherein said liner-less thermosensitive recording material further comprises a barrier layer which is formed between said substrate and said thermosensitive adhesive layer.

9. The liner-less thermosensitive recording material of claim 8, wherein said barrier layer comprises a water-soluble resin and the application amount of said barrier layer is about 0.1 to 5 g/m$^2$.

10. The liner-less thermosensitive recording material of claim 1, wherein said liner-less thermosensitive recording material further comprises a repeating pre-print image formed on at least one of said thermosensitive coloring layer and said protective layer and said perforation is formed between each pre-print image.

11. The liner-less thermosensitive recording material of claim 1, wherein said liner-less thermosensitive recording material further comprises a heat insulating layer which is formed between said substrate and said thermosensitive coloring layer and comprises a fine hollow particle whose shell comprises a resin.

12. The liner-less thermosensitive recording material of claim 11, wherein the average particle diameter of said hollow particle is about 0.4 to 10 μm and the hollow/particle ratio of said hollow particle is at least about 30%.

13. The liner-less thermosensitive recording material of claim 1, wherein said liner-less-thermosensitive recording material further comprises a heat insulating layer which is formed between said substrate and said thermosensitive adhesive layer and comprises a fine hollow particle whose shell comprises a resin.

14. The liner-less thermosensitive recording material of claim 13, wherein the average particle diameter of said hollow particle is about 0.4 to 10 μm and the hollow/particle ratio of said hollow particle is at least about 30%.

15. The liner-less thermosensitive recording material of claim 1, wherein said thermosensitive adhesive layer comprises an infrared absorbing agent which absorbs an infrared ray having wave length of about 0.7 to 2.5 μm.

16. The liner-less thermosensitive recording material of claim 15, wherein said infrared absorbing agent comprises at least one of carbon black and graphite.

17. The liner-less thermosensitive recording material of claim 15, wherein said infrared absorbing agent is present in a state of dissolved or a particle of smaller than about 2 μm in diameter and in an amount of about 0.005 to 0.3 g/m$^2$ in said thermosensitive adhesive layer.

18. The liner-less thermosensitive recording material of claim 1, wherein said liner-less thermosensitive recording material further comprises an intermediate layer which is formed between said substrate and said thermosensitive coloring layer and comprises an infrared absorbing agent which absorbs an infrared ray having wave length of about 0.7 to 2.5 μm.

19. The liner-less thermosensitive recording material of claim 18, wherein said infrared absorbing agent comprises at least one of carbon black and graphite.

20. The liner-less thermosensitive recording material of claim 18, wherein said infrared absorbing agent is present in a state of dissolved or a particle of smaller than about 2 μm in diameter and in an amount of about 0.005 to 0.3 g/m$^2$ in said thermosensitive adhesive layer.

21. The liner-less thermosensitive recording material of claim 1, wherein said liner-less thermosensitive recording material further comprises a barrier layer which is formed between said substrate and said thermosensitive adhesive layer.

22. The liner-less thermosensitive recording material of claim 21, wherein said barrier layer comprises a water-soluble resin and the application amount of said barrier layer is about 0.1 to 5 g/m$^2$.

23. A method of thermal recording, comprising heating imagewise a liner-less thermosensitive recording material, which comprises a substrate, a thermosensitive coloring layer formed on one side of said substrate, a thermosensitive adhesive layer which is formed on the other side of said substrate and which becomes adhesive when activated, while being non-adhesive in a normal state, an optional protective layer formed on said thermosensitive coloring layer, and perforation which is formed perpendicularly to the longitudinal direction of said liner-less thermosensitive recording material from the side of said thermosensitive coloring layer to form an image in said thermosensitive coloring layer, and activating said thermosensitive adhesive layer, wherein length of a non-cut part of said perforation is smaller than about 1.5 mm and a ratio of total length of cut parts to total length of the non-cut parts in said perforation is at least about 2, and wherein said thermosensitive adhesive layer comprises an infrared absorbing agent and is activated by infrared radiation.

* * * * *